US011412876B1

(12) United States Patent
Kadlub et al.

(10) Patent No.: US 11,412,876 B1
(45) Date of Patent: Aug. 16, 2022

(54) PACKAGED DELIVERY THEFT PREVENTION SYSTEM AND METHOD OF USE

(71) Applicants: Thomas E Kadlub, Cleburne, TX (US); Craig Kadlub, Cleburne, TX (US)

(72) Inventors: Thomas E Kadlub, Cleburne, TX (US); Craig Kadlub, Cleburne, TX (US)

( * ) Notice: Subject to any disclaimer, the term of this patent is extended or adjusted under 35 U.S.C. 154(b) by 0 days.

(21) Appl. No.: 15/910,577

(22) Filed: Mar. 2, 2018

Related U.S. Application Data

(60) Provisional application No. 62/465,941, filed on Mar. 2, 2017.

(51) Int. Cl.
*A47G 29/20* (2006.01)

(52) U.S. Cl.
CPC ..... *A47G 29/20* (2013.01)

(58) Field of Classification Search
CPC .... A47G 29/124; A47G 29/20; A47G 29/141; A47G 2029/144; E05B 73/0005; E05B 73/0023; E05B 45/005; B65D 33/1616; B65D 33/34; B65D 33/28; B65D 33/02; B65D 2211/00; B65D 55/028; B65D 55/14
USPC ..... 232/17, 19, 22, 45; 383/72, 75, 76; 70/64, 65
See application file for complete search history.

(56) References Cited

U.S. PATENT DOCUMENTS

| | | | | |
|---|---|---|---|---|
| 4,785,960 | A * | 11/1988 | Belisle | B65D 33/28 220/23.83 |
| 10,076,204 | B1 * | 9/2018 | Sadeghi | A47G 29/141 |
| 10,143,320 | B1 * | 12/2018 | Batts | A47G 29/124 |
| 10,282,951 | B1 * | 5/2019 | Kulick | A47G 29/20 |
| 10,321,780 | B1 * | 6/2019 | James | A47G 29/141 |
| 10,786,104 | B1 * | 9/2020 | Pappas | B65D 29/04 |
| 10,800,577 | B2 * | 10/2020 | Blubaugh | G08B 13/126 |
| 10,869,570 | B2 * | 12/2020 | Dunkelberger | E05B 73/00 |
| 2010/0085148 | A1 * | 4/2010 | Nesling | G07C 9/00912 340/5.73 |
| 2012/0269461 | A1 * | 10/2012 | Proctor | G09F 23/00 383/64 |
| 2013/0077896 | A1 * | 3/2013 | Wiley | A47G 29/20 383/86.2 |
| 2015/0305538 | A1 * | 10/2015 | Sundaresan | E05B 73/0005 232/36 |
| 2017/0055751 | A1 * | 3/2017 | Sundaresan | A47G 29/20 |
| 2018/0162612 | A1 * | 6/2018 | Bojic | B65D 55/14 |
| 2018/0202199 | A1 * | 7/2018 | Critz | B65D 33/34 |
| 2018/0228311 | A1 * | 8/2018 | Bloom | B64C 39/024 |

(Continued)

FOREIGN PATENT DOCUMENTS

| | | | | |
|---|---|---|---|---|
| CA | 2220810 | A1 * | 5/1999 | A47G 29/20 |
| DE | 202018103453 | U1 * | 8/2018 | A47G 29/20 |
| WO | WO-2015177590 | A1 * | 11/2015 | A47G 29/14 |

*Primary Examiner* — William L Miller
(74) *Attorney, Agent, or Firm* — Leavitt Eldredge Law Firm

(57) ABSTRACT

A theft prevention system for a delivered package includes a bag having a channel surrounding an opening of the bag; a locking device having a cable to be retained in the channel; and a building securing device to secure the bag to a building; the bag is to receive the delivered package; and the locking device is to cinch the bag closed while the locking device is locked.

12 Claims, 7 Drawing Sheets

(56) References Cited

U.S. PATENT DOCUMENTS

| | | | | |
|---|---|---|---|---|
| 2019/0038062 | A1* | 2/2019 | Sundaresan | A47G 29/1225 |
| 2019/0104876 | A1* | 4/2019 | Loures | A47G 29/20 |
| 2019/0133362 | A1* | 5/2019 | Gilligan | A47G 29/141 |
| 2019/0223644 | A1* | 7/2019 | Hopp | A47G 29/20 |
| 2019/0246828 | A1* | 8/2019 | Miller | A47G 29/20 |
| 2019/0269268 | A1* | 9/2019 | Blubaugh | B65D 55/14 |
| 2020/0015617 | A1* | 1/2020 | Izquierdo Gonzalez | A47G 29/20 |
| 2020/0060460 | A1* | 2/2020 | Farrar | A47G 29/141 |
| 2020/0323377 | A1* | 10/2020 | O'Connor | A47G 29/20 |
| 2020/0388095 | A1* | 12/2020 | Agbeyo | G08B 3/10 |
| 2021/0045563 | A1* | 2/2021 | Bartley-Clark | A47G 29/141 |
| 2021/0228012 | A1* | 7/2021 | Cheng | G07C 9/00912 |
| 2021/0267401 | A1* | 9/2021 | Benevento | E05B 65/52 |

* cited by examiner

PACKAGED DELIVERY THEFT PREVENTION SYSTEM AND METHOD OF USE

BACKGROUND

1. Field of the Invention

The present invention relates generally to package delivery systems, and more specifically, to a package delivery system for preventing and reducing the possibility of theft of a delivered package.

2. Description of Related Art

Package delivery systems are well known in the art and are effective means to for people to receive shipped packages. For example, FIG. 1 depicts a conventional package delivery system 101 having a package 103 left outside a door 105. During use, delivery personnel (not shown) deliver and leave package 103 outside of a building, where package 103 will remain until the homeowner discovers it.

One of the problems commonly associated with system 101 is theft. For example, package 103 can easily be picked up and carried away before the homeowner learns of the delivery.

Accordingly, although great strides have been made in the area of package delivery systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
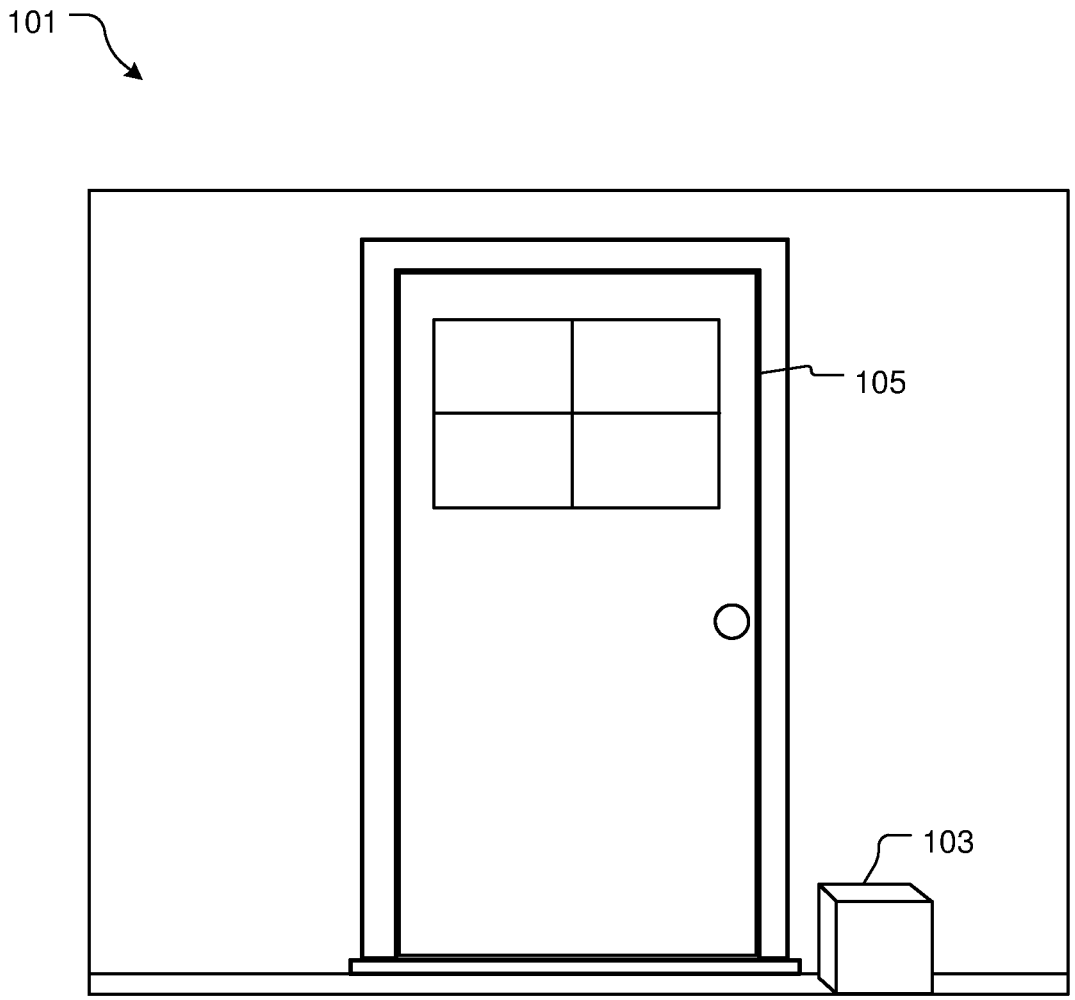
FIG. 1 (Prior Art)
FIG. 1 is a front view of a common package delivery system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional package delivery systems. Specifically, the present invention provides a means to reduce package theft. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
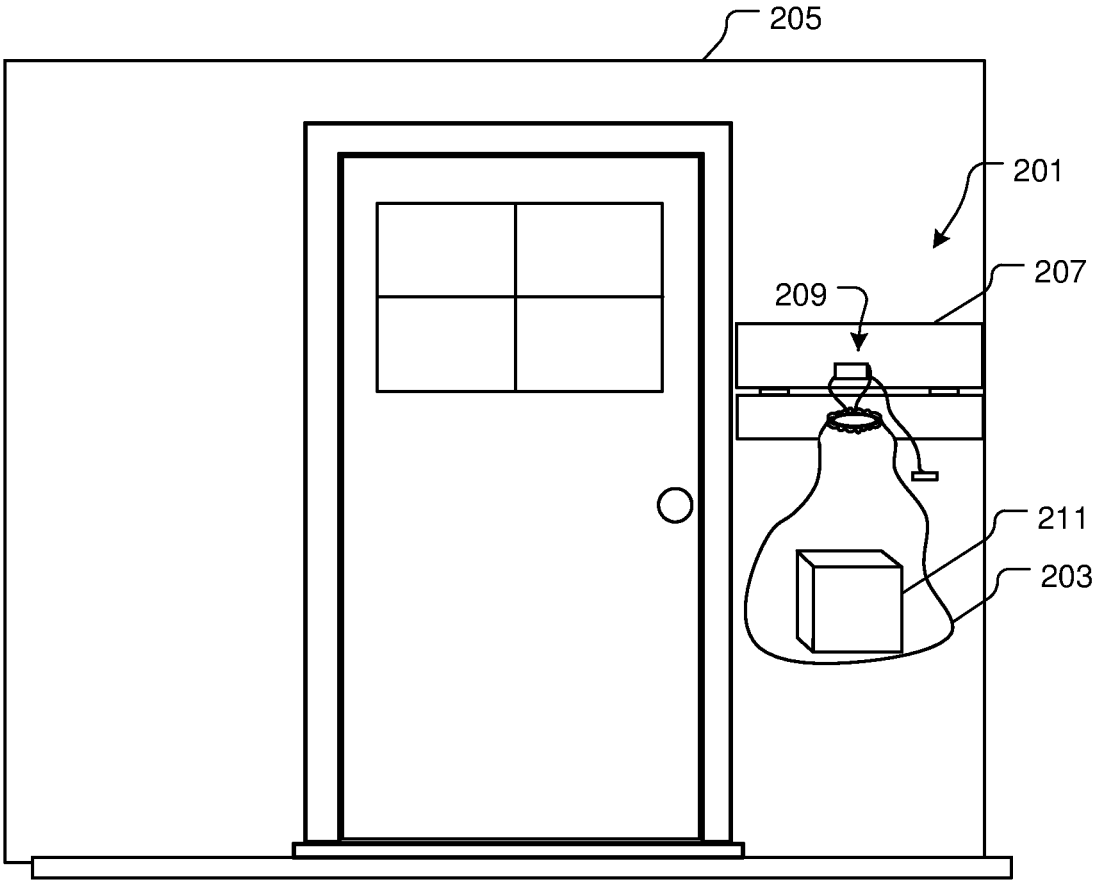
FIG. 2 is a front view of a package theft prevention system in accordance with a preferred embodiment of the present application.

Referring now to the drawings wherein like reference characters identify corresponding or similar elements throughout the several views, FIG. 2 depicts a front view of a package theft prevention system 201 in accordance with a preferred embodiment of the present application. It will be appreciated that system 201 overcomes one or more of the above-listed problems commonly associated with conventional package delivery systems.

In the contemplated embodiment, system 201 includes a bag 203 configured to be secured to a building 205 by a building securing device 207. Bag 203 is configured to be cinched into a locked position by a locking device 209. Locking device 209 is configured to substantially close bag 203 while locked, and remain locked until a user returns home and unlocks device 209 with a key or code. During use of system 201, a package 211 is placed inside bag 203, wherein the same is cinched closed, thereby locking package 211 to building 205. It should be appreciated that bag 203 can be composed of a tear resistant material, thereby further preventing theft.

It should be appreciated that one of the unique features believed characteristic of the present application is the use of a cinching lock device with a bag, wherein the same are secured to a building. It should be appreciated that this configuration allows for a package to be quickly secured to a building, thereby being convenient for delivery personnel and reducing the possibility of theft. Delivery personnel must merely drop the package into bag 203 and cinch the lock.

It should further be understood that the opening of bag 203 allows for the accommodation of a packages of many sizes, by being expandable and flexible. In addition, it is contemplated that an oversize package could be placed inside bag 203, wherein a portion of the package is protruding from the opening, and the cinching lock can be used to tighten around the package itself, thereby securing the oversized package to the building.

Figure 3A:
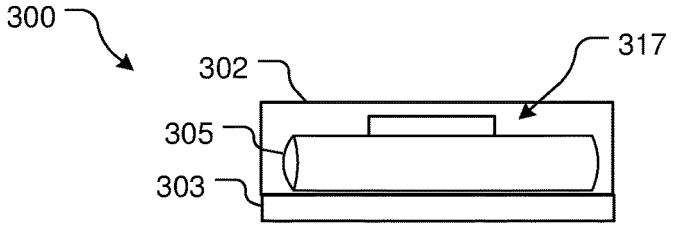
FIGS. 3A-3C are front views of the package theft prevention system from FIG. 2.
Figure 3B:
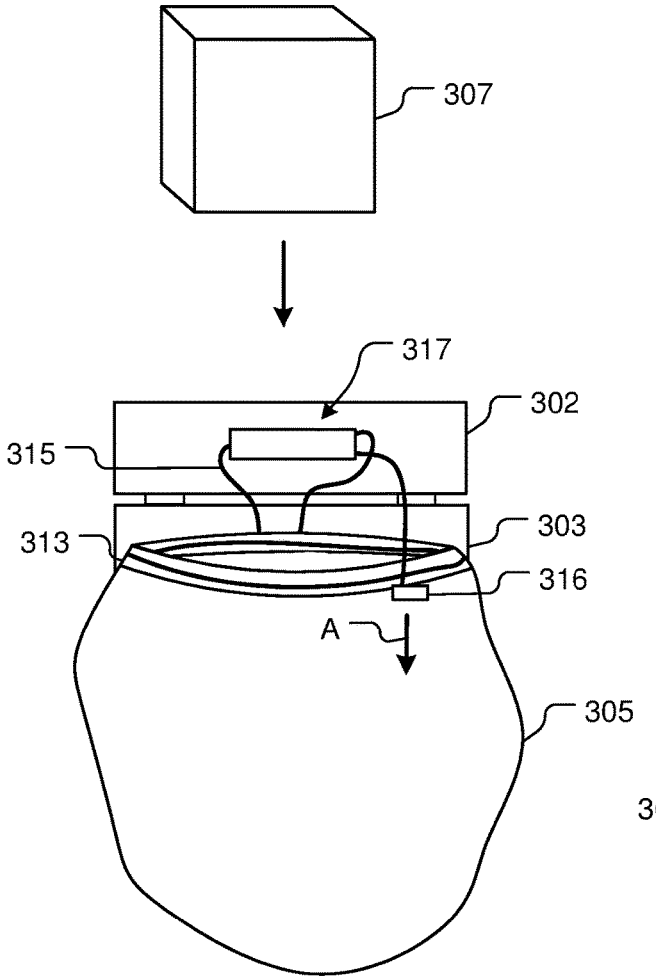
Figure 3C:
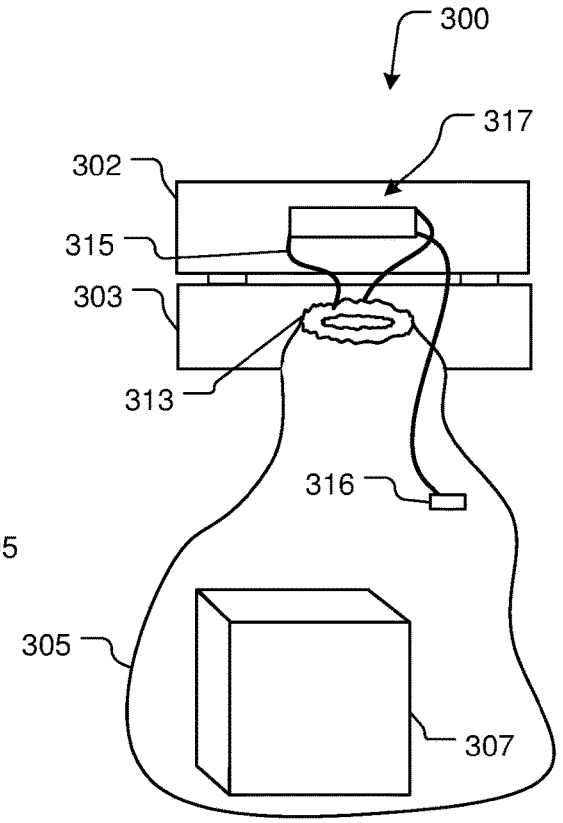

In FIGS. 3A-3C, one embodiment of a package theft prevention system 300 is shown. In system 300 the building securing device is a box 302 having a door 303. Box 302 can attach to a building by screws, bolts, or any other appropriate means. In this embodiment, a bag 305 can be rolled into a compact form and secured inside box 302, as shown in FIG. 3A. When a delivery personnel arrives with a package 307, door 303 is opened, thereby allowing bag 305 to drop out of box 302, as shown in FIG. 3B. Bag 305 is secured to box 301 by any appropriate means. One contemplated means is by mounting a locking device 317 inside box 302, wherein the locking device 317 retains bag 305 to box 302. Bag 305 includes a channel 313, wherein a cable 315 is retained and disposed through locking device 317. It should be appreciated that alternative embodiments contemplate using rope, cord, or other similar devices in place of cable 315.

Once package 307 is placed inside bag 305, cable 315 is pulled by a handle 316, as indicated with arrow A, wherein locking device 317 cinches bag 305 closed, thereby locking package 307 inside bag 305, as shown in FIG. 3C. It is contemplated that channel 313 can be sewn into bag 305, or alternatively can include a plurality of rings sewn to bag 305 for receiving cable 315.

Figure 4A:
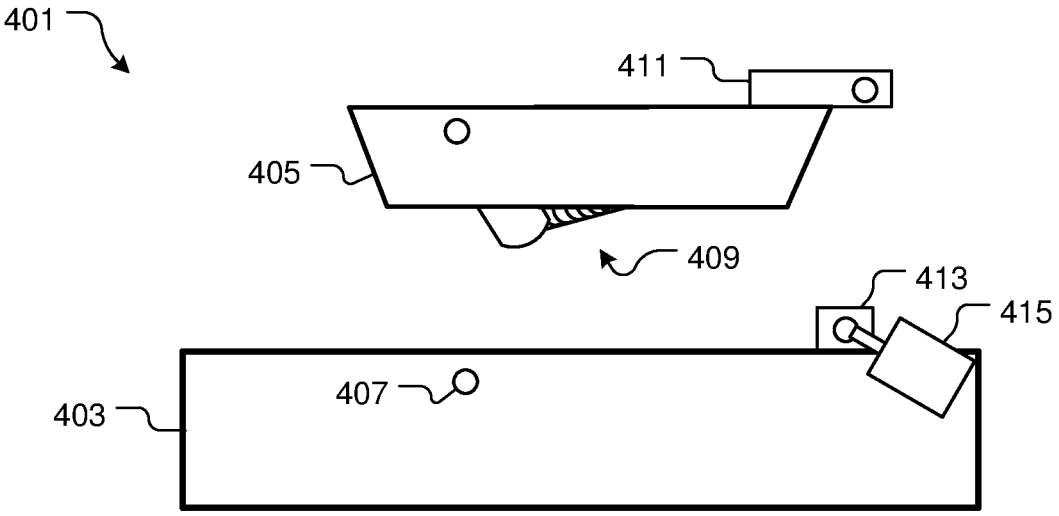
FIGS. 4A-4C are front views of a locking device from FIG. 2.
Figure 4B:
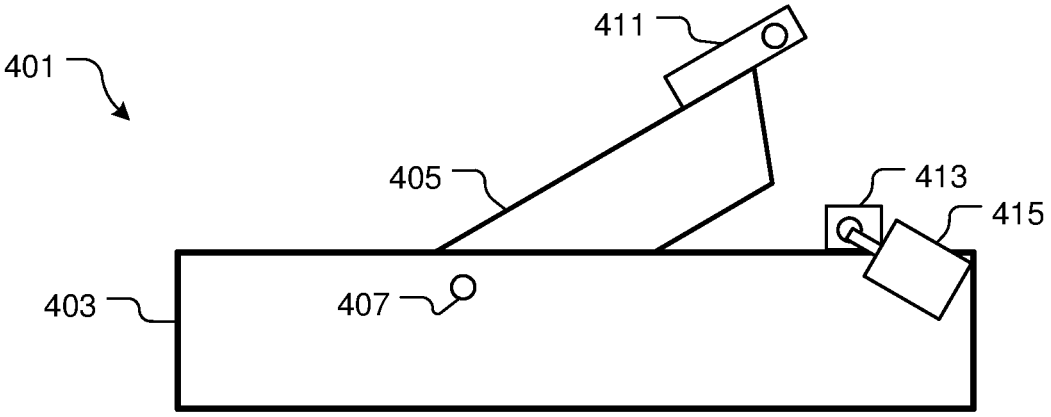
Figure 4C:
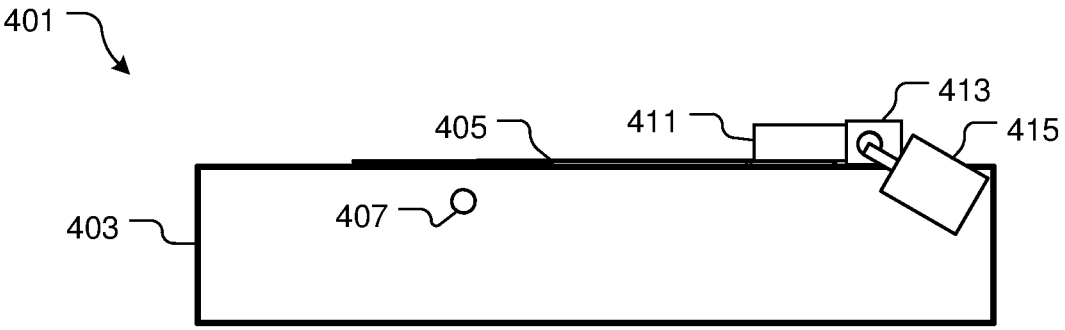

In FIGS. 4A-4C, front views of a locking device 401 configured to be used with system 201 is shown. Locking device 401 includes a base 403 and a clamp 405 configured to secure to base 403 at a pivot point 407. Clamp 405 houses a cam device 409 configured to be secured inside base 403. Clamp 405 and base 403 include lock receiving braces 411, 413, wherein a lock 415, such as a padlock, can lock clamp 405 in a closed position, as shown in FIG. 4C. In the locked position, a cable (not shown) can only move in one direction. Lock 415 must be removed to allow clamp 405 to open, as shown in FIG. 4B, thereby allowing the cable (not shown) to freely move inside base 403.

Figure 5A:
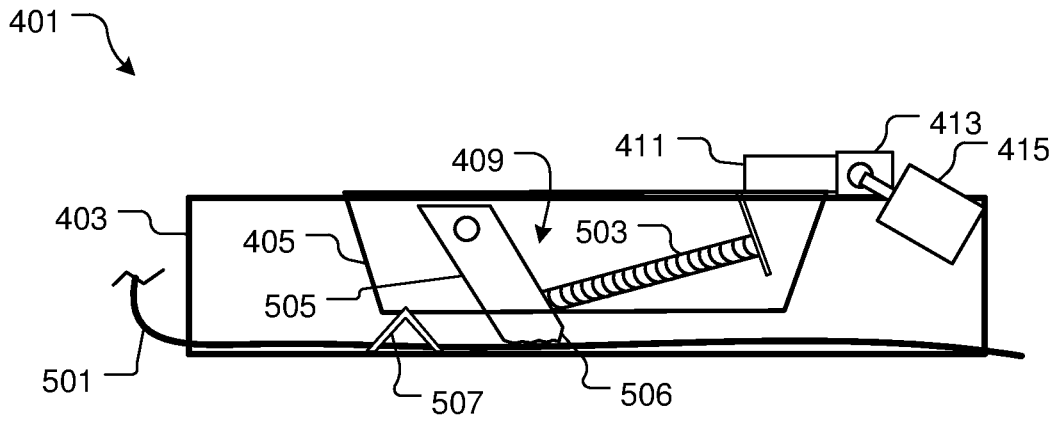
FIGS. 5A-5C are front views of a mechanism of the locking device from FIGS. 4A-4C.
Figure 5B:
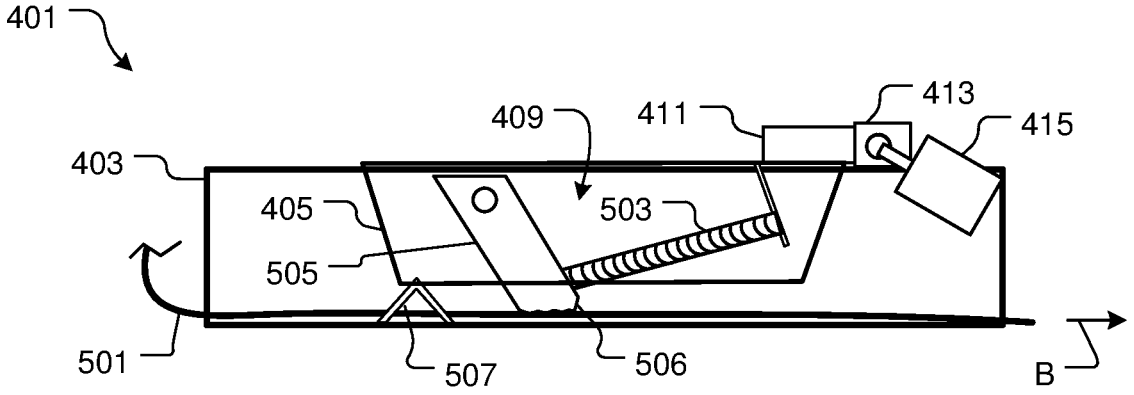
Figure 5C:
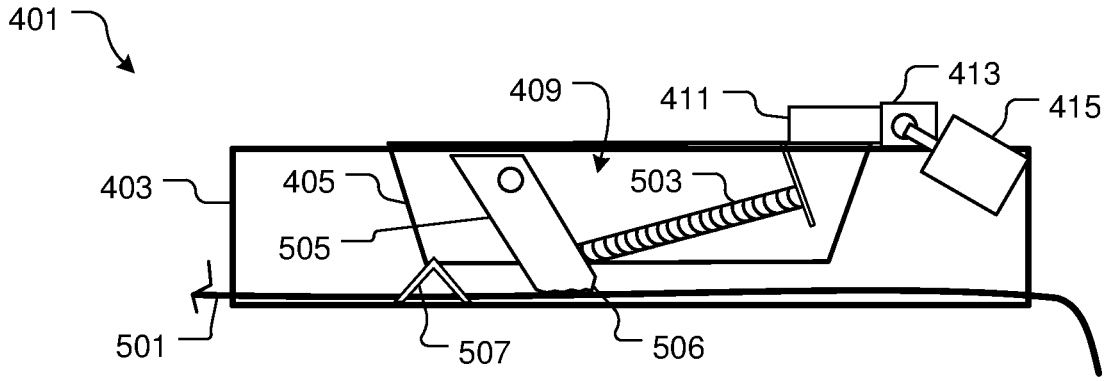

In FIGS. 5A-5C, the movement of a cable 501 inside locking device 401 is shown. Cam device 409 includes a spring 503 secured to an arm 505. Arm 505 is positioned to tightly secure against cable 501, wherein an end 506 of arm 505 has a plurality of ridges configured to allow for movement of cable 501 in one direction, as indicated with arrow B. The plurality of ridges grip cable 501 to prevent movement in the opposite direction. Locking device 401 can further include a cable guide 407 configured to center cable 501 in the bottom of housing 403 to ensure that cable 501 aligns with arm 505. It should be appreciated that this configuration allows for the locking device 401 to remain locked when the delivery personnel insert a package into the bag, therefore the delivery personnel must simply cinch the locking device to secure the package to the building. In order to release cable 501, lock 415 must be removed, and clamp 405 must be opened.

Figure 6:
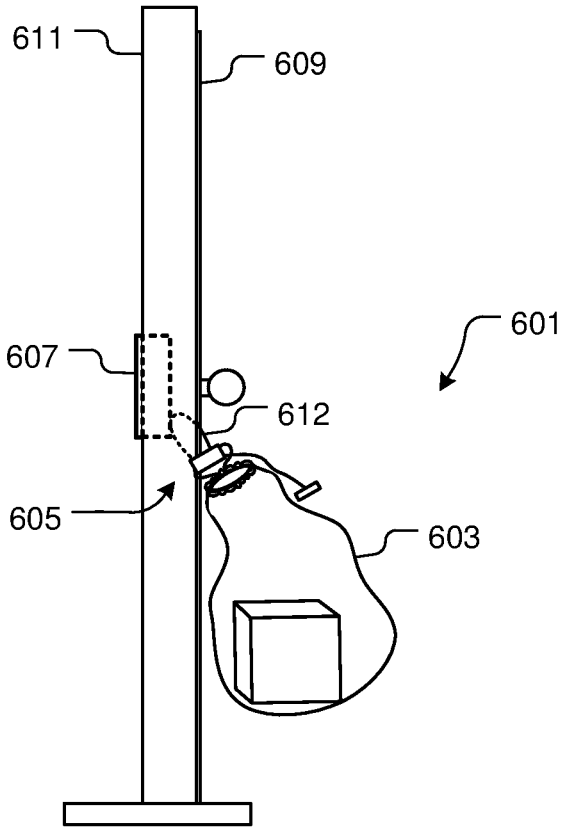
FIG. 6 is a side view of an alternative embodiment of a package theft prevention system in accordance with the present application.

Another unique feature believed characteristic of the present application is locking device 401. It should be appreciated that locking device 401 provides a means for delivery personnel to lock a package into a bag without the hassle of having to unlock device 401 first, or to subsequently lock device 401. This locking device allows for the delivery personnel to quickly drop a box inside a bag and cinch the bag closed. It is contemplated that locking device 401 can be used independently of a bag to lock around a package, thereby securing the package to a building In FIG. 6, a side view of an alternative embodiment of a delivery theft prevention system 601 is shown. In this embodiment, system 601 includes a bag 603 and a locking device 605, being substantially the same as system 201. System 601 further includes a bracket 607 configured to secure between a door 609 and a door frame 611, wherein bag 603 and locking device 605 are secured to bracket 607 by any appropriate means, such as a cable 612. It should be appreciated that this embodiment allows for a user install system 601 only when they are expecting a delivery. It should be understood that bracket 607 can be any appropriate shape, such as an L shape, wherein the bracket can be retained between door 609 and frame 611 when door 609 is closed. It should further be appreciated that bracket 607 can be composed of any appropriate material, including metal, wood, or a tear resistant fabric. In addition, it is contemplated that bracket 607 can have a thin strip configured to be secured between the door 609 and door frame 611, and a thick end configured to be retained on the interior of the building. This configuration would allow for the user to quickly close the bracket into the door frame 611, with the thick end holding the bracket in place.

Figure 7:
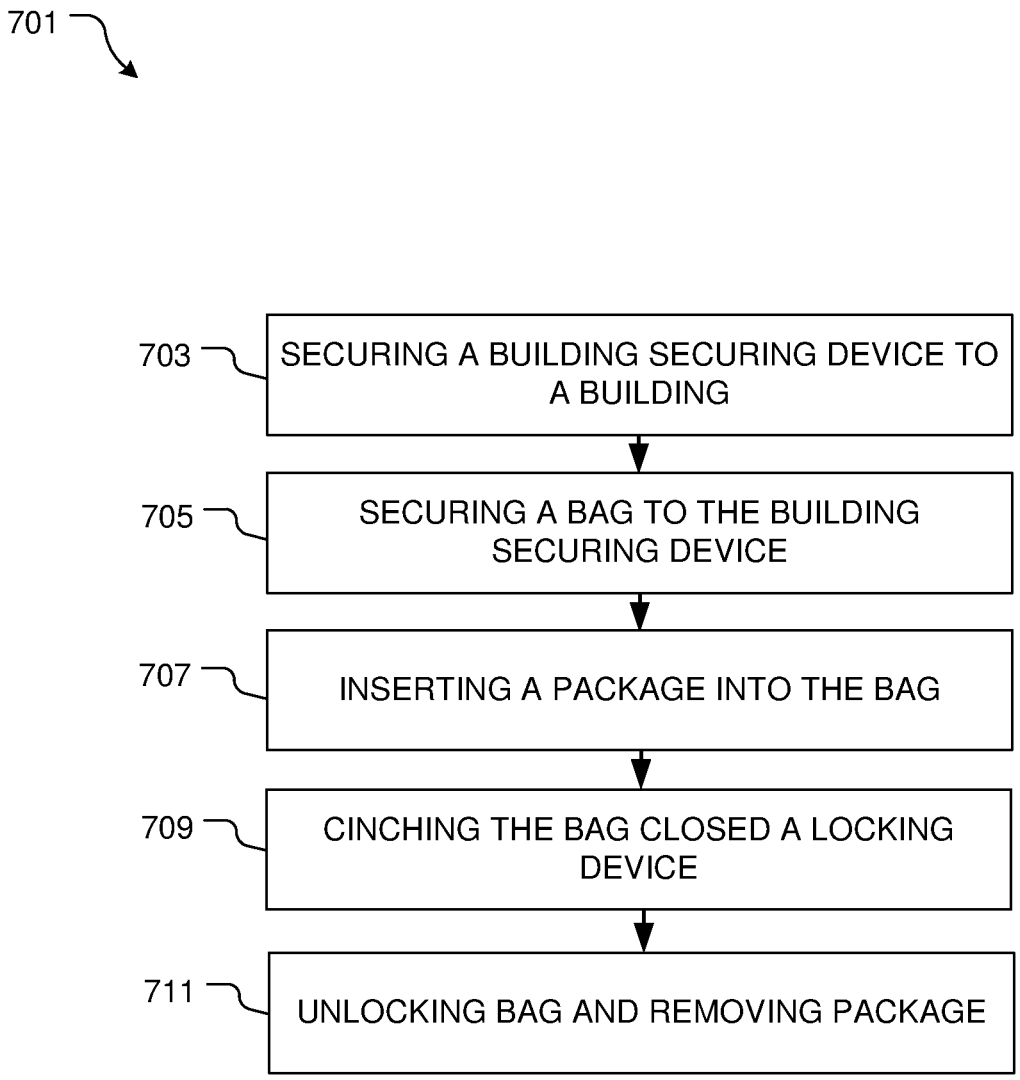
FIG. 7 is a flowchart of the method of preventing package theft in accordance with the present application.

In FIG. 7, a flowchart 701 depicts a method of package theft prevention associated with system 201 and system 601. The building securing device, whether a bracket or a box, is secured to the building, either via screws, bolts, or a similar means, as shown with box 703. A bag is then secured to the building securing device via a cable or another appropriate means, as shown with box 705. When a delivery is made, the package is inserted into the bag, which is then cinched closed by the locking device, as shown with boxes 707, 709. To remove the package, the user must unlock the locking device, thereby releasing the cable and loosening the bag, as shown with box 711.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A theft prevention system for a delivered package, the system comprising:

a bag having a channel surrounding an opening of the bag;

a locking device, having a cable configured to be retained in the channel; and a building securing device configured to secure the bag to a building, the building securing device having:

a box mounted on a building, the box having:

a door; and a bracket inside the box and configured to attach to the bag;

wherein the bag is retained inside the box and removable via the door; and wherein the bracket prevents the bag from being fully removed from the box;

wherein the bag is configured to receive the delivered package; and wherein the locking device is configured to cinch the bag closed while the locking device is locked.

2. The system of claim 1, wherein the bag is composed of a tear resistant material.

3. The system of claim 1, wherein the channel is sewn into the bag.

4. The system of claim 1, wherein the channel comprises a plurality of rings sewn into the bag.

5. The system of claim 1, wherein the locking device is an adjustable cable lock.

6. The system of claim 1, wherein the locking device comprises:

a housing configured to lock the cable at a desired length, the housing having:

a base with a channel for receiving the cable therein; and a clamp pivotally connected to the base and configured to close into the channel and against the cable; and a lock configured to secure the clamp in a closed position;

wherein the cable will cinch in one direction when the clamp is locked in the closed position.

7. A method of reducing a potential for theft of a delivered package, the method comprising:

providing the system of claim 1;

attaching the building securing device to the building;

securing the bag to the building securing device;

inserting the delivered package into the bag; and cinching the bag closed via the locking device.

8. The method of claim 7, further comprising:

unlocking the locking device and removing the package from the bag.

9. A locking device for cinching into a locked position, the locking device comprising:

a cable; and a housing configured to lock the cable at a desired length, the housing having:

a base with a channel for receiving the cable therein; and a clamp pivotally connected to the base and configured to close into the channel and against the cable;

a lock configured to secure the clamp in a closed position;

wherein the cable will cinch in one direction when the clamp is locked in the closed position.

10. The locking device of claim 9, wherein the clamp further comprises:

a spring loaded cam configured to press against the cable when the clamp is in the closed position;

wherein the spring loaded cam allows for movement of the cable in one direction and prevents the cable from moving in a second direction.

11. The locking device of claim 9, further comprising:

a cable guide extending from a bottom of the base into the channel;

wherein the cable guide positions the cable in the center of the base.

12. The locking device of claim 9, further comprising:

a first brace extending from the base and having a first hole;

a second brace extending from the clamp and having a second hole; and the lock in the form of a padlock;

wherein the first and second holes are aligned when the clamp is closed; and wherein locking the padlock through the first and second holes locks the clamp in the closed position.

* * * * *